US005785174A

United States Patent [19]

Chow

[11] Patent Number: 5,785,174

[45] Date of Patent: Jul. 28, 1998

[54] DISPLAY PACK HAVING A ROTATABLE SECURITY MEMBER

[75] Inventor: Jessie Chow, Taichung, Taiwan

[73] Assignee: Hand Tool Design Corporation, Wilmington, Del.

[21] Appl. No.: 879,225

[22] Filed: Jun. 19, 1997

[51] Int. Cl.[6] ..... A45C 11/26

[52] U.S. Cl. ..... 206/349; 206/376; 206/461; 206/471; 206/493

[58] Field of Search ..... 206/349, 376, 206/377, 461, 471, 493, 495; 211/70.6; 248/309.1

[56] References Cited

U.S. PATENT DOCUMENTS

| | | | |
|---|---|---|---|
| 3,516,585 | 6/1970 | Inwood | 206/349 |
| 4,056,190 | 11/1977 | Dix | 206/471 |
| 4,872,551 | 10/1989 | Theros | 206/349 |
| 4,997,085 | 3/1991 | Brennan | 206/376 |
| 5,595,295 | 1/1997 | Lin | 206/349 |
| 5,713,467 | 2/1998 | Kao | 206/349 |

FOREIGN PATENT DOCUMENTS

| | | | |
|---|---|---|---|
| 2652064 | 3/1991 | France | 206/349 |
| 2187714 | 9/1987 | United Kingdom | 206/349 |

*Primary Examiner*—David T. Fidei

*Attorney, Agent, or Firm*—Lowe Hauptman Gopstein Gilman & Berner

[57] ABSTRACT

A display pack having a rotatable security member includes a board and the rotatable security member wherein the board has a first hole and a second hole respectively defined therein and an inverted U-shaped frame extends perpendicularly from a front surface of the board with the second hole being located between two extending portions of the inverted U-shaped frame. The second hole has a toothed inner periphery and the rotatable security member includes a polygonal head and a shank which has a flange extending from a free end thereof and a toothed periphery defined in an outer periphery near the flange so that the rotatable security member is rotatably inserted into the second hole with the toothed inner periphery engaged with the toothed inner periphery. A ratchet tool is engaged with the rotatable security member and can be operated within a limited angle between the two extending portions of the frame.

4 Claims, 6 Drawing Sheets

DISPLAY PACK HAVING A ROTATABLE SECURITY MEMBER

BACKGROUND OF THE INVENTION

1. Field of the Invention

The present invention relates to a display pack and, more particularly, to an improved display pack having a rotatable security member disposed thereto so that a ratchet tool is operatably engaged to the security member.

2. Brief Description of the Prior Art

Hardware stores use display packs to display tools on walls and these tool display packs each have a simple structure and can be hung on the hook so that the tool is fixedly connected to the display pack by way of mounting a transparent cover to the display pack with the tool received between the cover and the display pack. Generally, the conventional display pack provides an main advantage is that customers can see the whole configuration of the tool. An inherent shortcoming of the tool display pack is that the tool, such as a ratchet tool, cannot be operated by customers. Furthermore, each of the each of the tools have to be transported to a packing plant to be packed in display packs, and this requires a high cost.

Another type of display packs include a board portion and a ring member disposed to the board so that a tool is simply supported and wrapped by the ring member. However, this type of display packs are easily broken simply by pulling the tool to break the ring member. Therefore, a thief can remove the tool and conceal it about his person.

The present invention intends to provide an improved display pack to mitigate and/or obviate the above-mentioned problems.

SUMMARY OF THE INVENTION

The present invention provides a display pack and comprises a board and a rotatable security member. The board has a first hole and a second hole respectively defined therethrough, wherein the second hole has a toothed inner periphery. An inverted U-shaped frame extends perpendicularly from a front surface thereof with the second hole being located between two extending portions of the frame. The rotatable security member includes a polygonal head and a shank extending from the head. The shank has at least one flange extending radially from a free end thereof and a toothed periphery defined in an outer periphery thereof near the flange such that the rotatable security member is rotatably inserted into the second hole with the toothed periphery being engaged with the toothed inner periphery.

It is an object of the present invention to provide a display pack which has a rotatable security member disposed thereto which is cooperated with a ratchet tool such that the ratchet tool can be operated within a limit angle.

It is another object of the present invention to provide display pack having a rotatable security member disposed thereto so as to prevent the tool engaged with the rotatable security member from being taken away from the display pack without permission.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
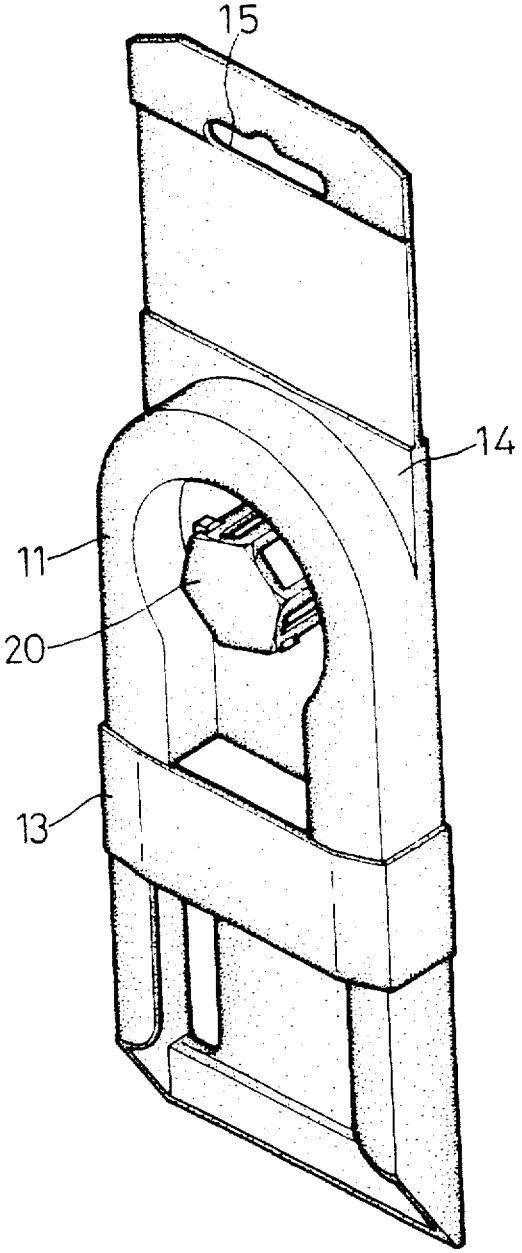
FIG. 1 is a perspective view of a display pack having a rotatable security member in accordance with the present invention.
Figure 2:
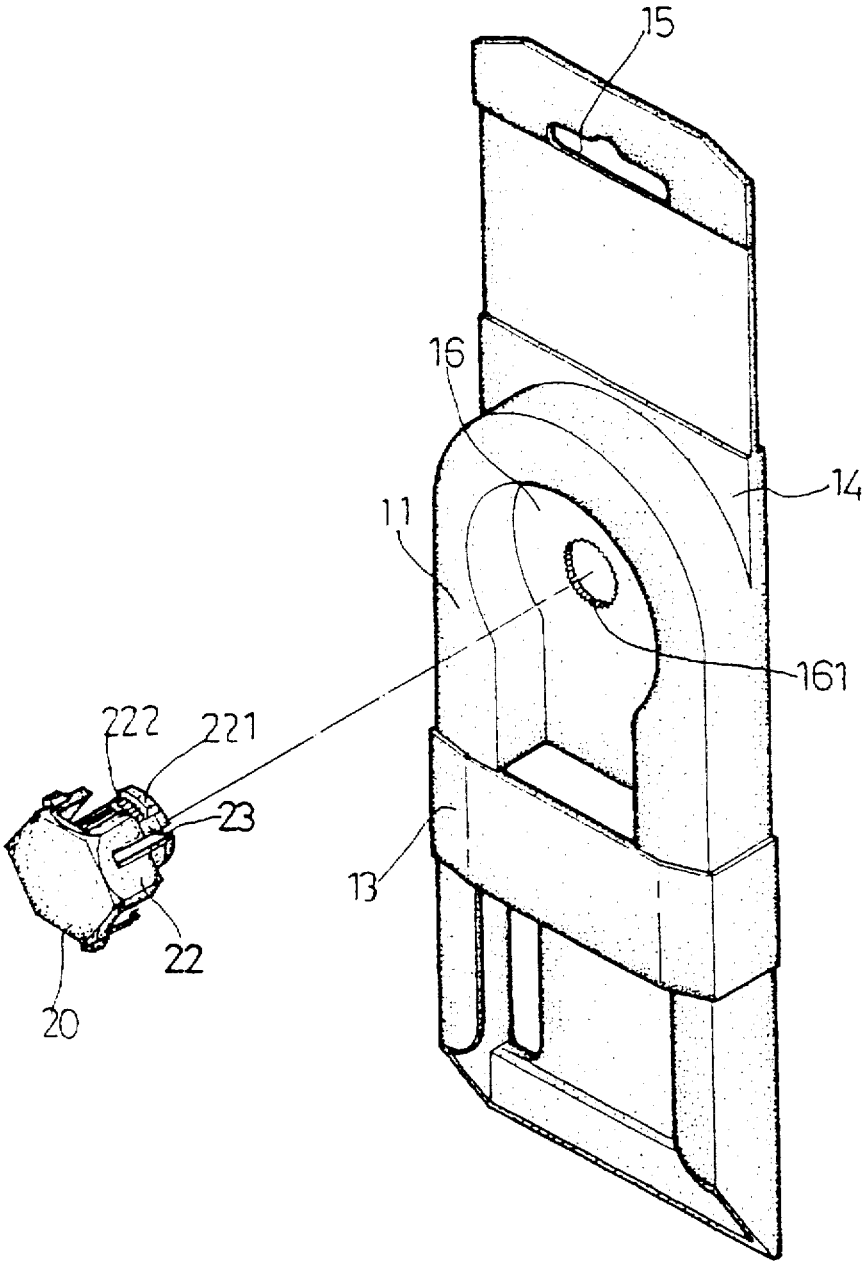
FIG. 2 is an exploded view of the display pack and the rotatable security member in accordance with the present invention.
Figure 3:
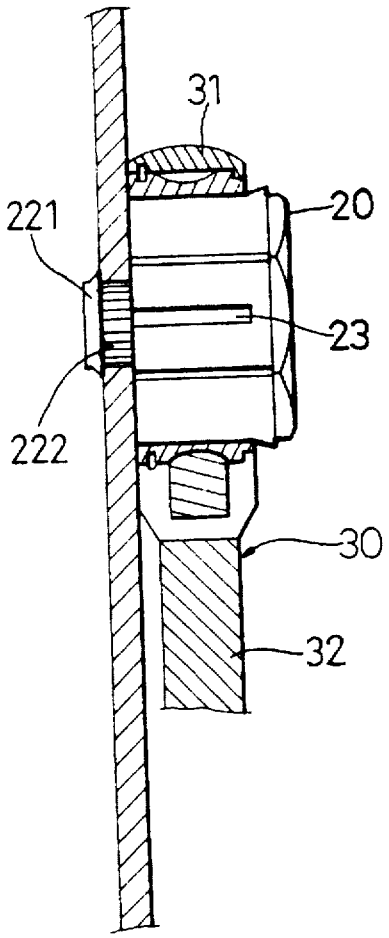
FIG. 3 is a side elevational view, partly in section, of the display pack with a ratchet tool being engaged with the rotatable security member.

Referring to the drawings and initially to FIGS. 1 through 3, a display pack in accordance with the present invention generally includes a board 14 and a rotatable security member 20 wherein the board 14 has a first hole 15 defined in a position near a top area thereof so as to be hung on a rack (not shown) for example and a second hole 16 defined in a position near a middle portion thereof. The second hole 16 has a toothed inner periphery 161. The board 14 has an inverted U-shaped frame 11 extending perpendicularly from a front surface thereof with the second hole 16 being located between two extending portions of the frame 11 and a limit plate 13 is connected between the two extending portions of the inverted U-shaped frame 11.

The rotatable security member 20 includes a polygonal head 21, a hexagonal head in this embodiment, and a shank 22 extending from one of two sides of the head 21. The shank 22 has at least one flange 221 extending radially from a free end thereof and at least two slits 23 defined longitudinally therein which open to the free end. The flange 221 has a diameter slightly larger than that of the second hole 16 so that the flange 221 is engaged with a rear surface of the board 14 when the shank 22 of the rotatable security member 20 is inserted into the second hole 16 by force. A toothed periphery 222 is defined in an outer periphery of the shank 22 and is located near the flange 221 such that the rotatable security member 20 is rotatably inserted into the second hole 16 with the toothed periphery 222 being engaged with the toothed inner periphery 161. It is noted that the toothed periphery 222 and the toothed inner periphery 161 are made by plastic and have small teeth so that the rotatable security member 20 is rotatable in the second hole 16 with the toothed periphery 222 shifting on the toothed inner periphery 161.

Figure 4:
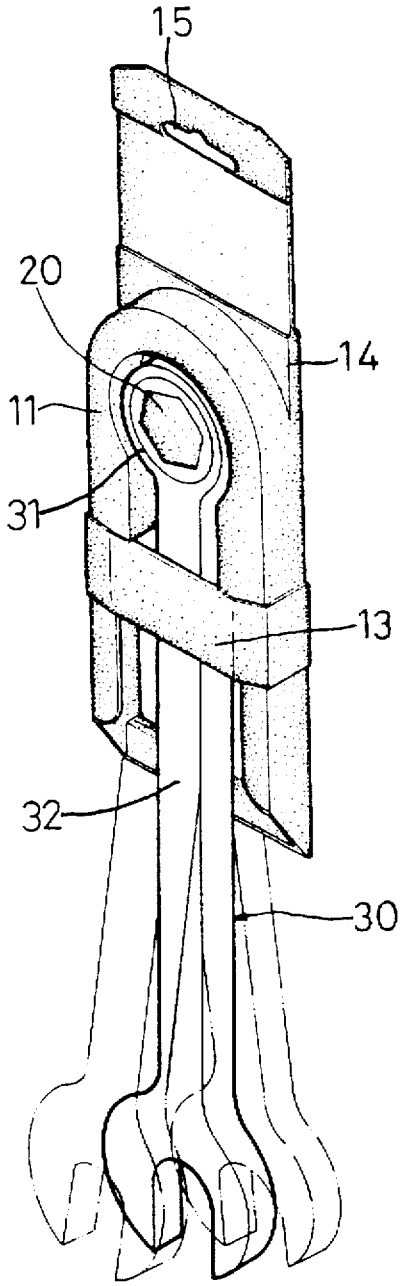
FIG. 4 is an illustrative view to show the ratchet tool engaged with the rotatable security member is operated with a limited angle.

Further referring to FIG. 4, a ratchet tool 30 has its operation head portion 31 mounted to the rotatable security member 20 and its shank portion 32 extending between the two extending portions of the inverted U-shaped frame 11 such that a customer (not shown) can operate the ratchet tool 30 by swinging the shank portion 32 of the ratchet tool 30. The relationship mentioned above between the toothed periphery 222 and the toothed inner periphery 161 will cause the ratchet tool 30 to be operated as if it is fastening or unfastening an object.

Accordingly, the present invention allows customers to operate the ratchet tool 30 attached to the display pack in accordance with the present invention and the ratchet tool 30 is easily to be attached to the display pack.

Figure 5:
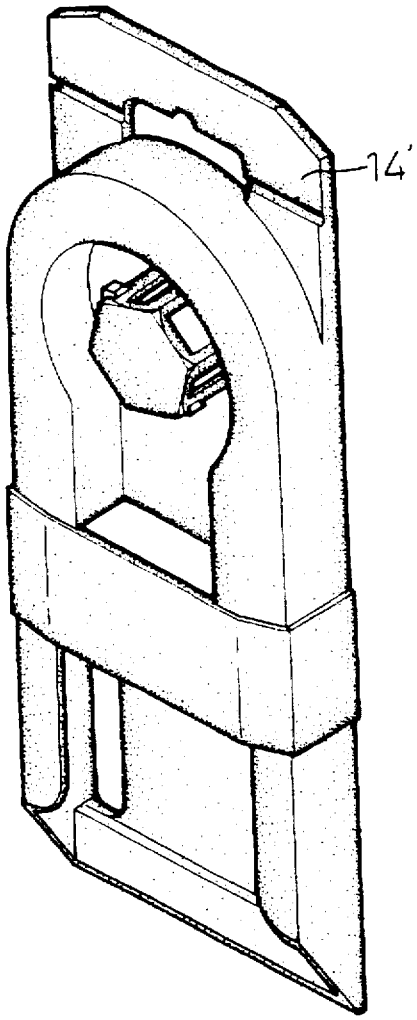
FIG. 5 is a perspective view of another embodiment of the display pack having a rotatable security member in accordance with the present invention.
Figure 6:
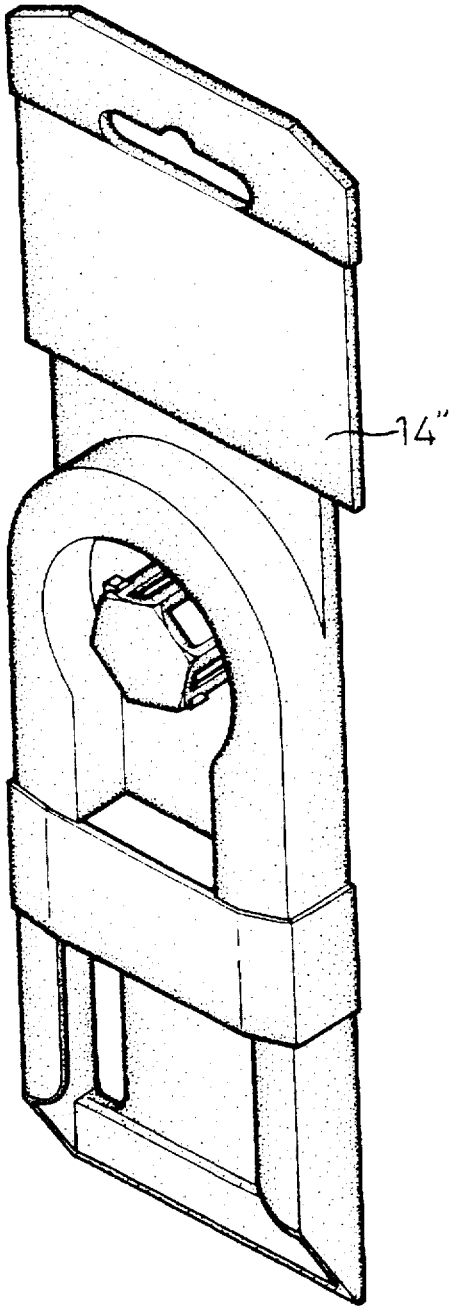
FIG. 6 is a perspective view of yet another embodiment of the display pack having a rotatable security member in accordance with the present invention.

FIGS. 5 and 6 respectively show different embodiments of the display pack in accordance with the present invention with a shorter board 14' and a longer board 14".

Although the invention has been explained in relation to its preferred embodiment, it is to be understood that many other possible modifications and variations can be made without departing from the spirit and scope of the invention as hereinafter claimed.

What is claimed is:

1. A display pack comprising:

a board having a first hole and a second hole respectively defined therethrough, said second hole having a toothed inner periphery, said board having an inverted U-shaped frame extending perpendicularly from a front surface thereof with said second hole being located between two extending portions of said frame, and a rotatable security member including a polygonal head and a shank extending from one of two sides of said head, said shank having at least one flange extending radially from a free end thereof and a toothed periphery defined therein near said flange such that said rotatable security member is rotatably inserted into said second hole with said toothed periphery being engaged with said toothed inner periphery.

2. The display pack as claimed in claim 1 wherein said flange has a diameter slightly larger than that of said second hole so that said shank is force-fitted into said second hole with said flange being engaged with a rear surface of said board.

3. The display pack as claimed in claim 1 wherein a limit plate is connected between said two extending portions of said inverted U-shaped frame.

4. The display pack as claimed in claim 1 wherein at least two slits are defined longitudinally in said shank and open to said free end of said shank.

* * * * *